US005765309A

United States Patent [19]

Mamchych

[11] Patent Number: 5,765,309

[45] Date of Patent: Jun. 16, 1998

[54] MULLION LATCH

[76] Inventor: Victor Mamchych, 8875 Schisler Rd., Welland, Ontario L3B 5N4, Canada

[21] Appl. No.: 666,139

[22] Filed: Jun. 19, 1996

[51] Int. Cl.[6] ..... E06B 5/00

[52] U.S. Cl. ..... 49/365

[58] Field of Search ..... 49/365, 366, 49; 52/207, 210

[56] References Cited

U.S. PATENT DOCUMENTS

| | | | |
|---|---|---|---|
| 2,275,730 | 3/1942 | Casse | 49/365 |
| 3,000,062 | 9/1961 | McCandless . | |
| 3,319,382 | 5/1967 | Hand | 49/365 X |
| 5,435,102 | 7/1995 | McCarthy | 49/365 X |
| 5,450,697 | 9/1995 | Prucinsky et al. | 49/365 X |

OTHER PUBLICATIONS

Von Duprin, Inc. Sales Literature, 1994, (3 pages) Title—Von Duprin® Keyed Removable Mullion.

*Primary Examiner*—Jose V. Chen

*Attorney, Agent, or Firm*—Peter F. Casella

[57] ABSTRACT

A mullion latch is provided that will firmly secure a mullion post and yet permit the mullion post to be readily removable and reinstallable without tools. The mullion latch is used in conjunction with a double door opening that is designed to accommodate two single doors making use of the mullion post for their locking mechanisms, such as panic rim devices. Adapters are provided which may be used with the mullion latch in combination with a variety of mullion shapes, extruded or otherwise, that are employed in double door mullion assemblies, thereby negating any need to replace existing mullion posts when being adapted to employ the mullion latch. An assembly kit is provided for retrofitting or adapting existing mullion posts to be readily removable and reinstallable which includes the mullion latch combined with an adapter for use with a variety of existing moveable hollow core mullion shapes.

17 Claims, 5 Drawing Sheets

MULLION LATCH

BACKGROUND OF THE INVENTION

In most commercial, industrial and institutional buildings, including schools, hospitals, hotels and similar type structures, double doors hung in metal frames are used. In many cases these doors are latched to a center post, called a mullion, that allow use of single doors in double door frames. In many instances the mullion is a movable hollow core mullion and can be removed to allow for large loads to be passed through the doors and then reinstalled. The mullion post holding systems currently in use employ sliding wedges, hold-down clips, wrap around brackets among other types of hold down devices and are attached with various kinds of screws or bolts to fittings in the floor and top of the door frame. These become worn, rusted, clogged with dirt and grime and generally deteriorate with use and age and are invariably painted over. It is with the removal and reinstallation of such mullions that problems occur thereby making it a time consuming job, requiring tools and other measures to remove and replace the mullion.

PRIOR ART

Various attempts have been made to overcome the problems associated with removing and reinstalling movable mullions. Movable mullions that do not require screwing and bolting are known.

U.S. Pat. No. 2,275,730 issued on Mar. 10, 1942 to Casse discloses a removable mullion which is designed for overhead doors, and is held in place by a spring type clamp or latch to hold the mullion in place and allow for its removal and attachment.

U.S. Pat. No. 3,000,062 issued on Sep. 19, 1961 to McCandless discloses a mullion that is held in place by the use of pressure applied to the mullion during installation, and release upon removal.

U.S. Pat. No. 3,319,382 issued on May 16, 1967 to Hand shows a mullion unit that is forced over a base plate and held by friction, and is slid into an upper joint by additional friction and held in place by a screw type unit. The method of fixing the mullion in place is only broadly defined in this description.

U.S. Pat. No. 5,435,102 issued on Jul. 25, 1995 to McCarthy shows a mullion fastened to a base unit and hinged to allow its tilting into a horizontal position after it is released at the top of the doorway. The unit also allows for the complete removal of the mullion. The fastening device in this unit is a key operated lock.

U.S. Pat. No. 5,450,697 issued on Sep. 19, 1995 to Prucinsky is very similar to the McCarthy patent, assigned to the same assignee, which extends the McCarthy patent by using key operated locks at either end of the mullion for easier removal, as well as disclosing different base and top attachment units.

In both U.S. Pat Nos. 5,435,102 and 5,450,607 which represent the most recent state of the art, devices that employ a keyed cylinder with a cam to actuate a plunger or mortise dead bolt are used. The key cylinder is a delicate mechanism depending on small sensitive springs and pins that are susceptible to moisture, freeze up, corrosion or heat. At the most crucial times during emergencies these systems can fail after lengthy non use and especially if the key can not be found readily.

Although these patents address the problem of providing removable mullions, they have many disadvantages as will be come apparent hereinafter. Furthermore, none of them show the simple, durable, easy to use and maintain, inexpensive mullion latch of this invention which is friendly to the user and allows for easy and rapid removal and reinstallation of removable mullions.

OBJECTS OF THE INVENTION

It is an object of this invention to provide a mullion latch that enables the rapid removal and reinstallation of a hollow mullion post that is simple, durable, easy to use, inexpensive, economical to make and easy to maintain and which is friendly to the user. It is also an object of this invention to provide a mullion latch for use at the top of the mullion post that will eliminate the need for any tools or keys for the removal and reinstallation of the mullion post. It is still a further object of this invention to provide a mullion latch which may be adapted for use in combination with a variety of mullion shapes that are employed in double door mullion assemblies. It is another object of this invention to provide adapters for use with the mullion latch of this invention with the variety of hollow core mullion shapes in use in double door mullion assemblies. It is another object of this invention to provide an assembly kit for retrofitting or adapting existing mullions to be readily removable and reinstallable which includes the mullion latch of this invention combined with an adapter for use with a variety of hollow mullion shapes. It is a further object of this invention to provide a mullion latch which is easy to operate under any conditions day or night, that does not have to be touched during reinstallation of the mullion post and which one person can handle in either the removal or reinstalling operation. It is a further object of this invention to provide a mullion latch which will not allow the mullion post to fall out even if the latch is tripped. It is a further object of this invention to provide a mullion latch which is aesthetically neat and clean and will not be clogged up with dirt and grime and which is durable and requires little or no maintenance.

These and other objects and advantages, which are accomplished by the mullion latch, the adapters and the retrofit assembly kit of this invention, will become apparent from the description and accompanying drawings which illustrate preferred embodiments of this invention. A brief description of the Drawings or Figures follows.

THE FIGURES

Figure 2:
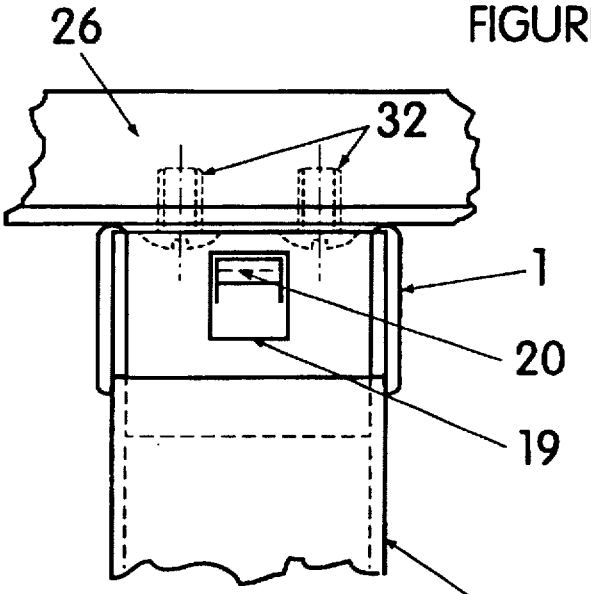
FIG. 2 is an expanded elevation view from the inside of the doors, showing the mullion latch secured in the top frame or header of the double door frame.
Figure 2A:
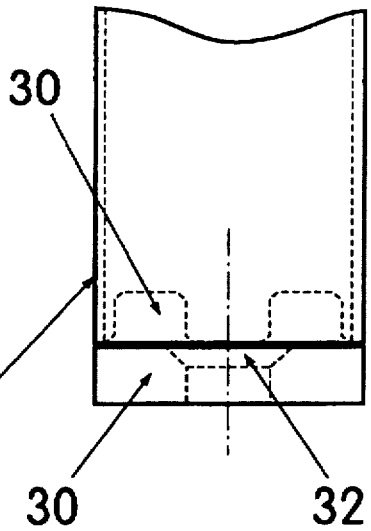

FIG. 2*a* is an expanded elevation view from inside of the swinging doors, showing the floor plate and its retaining protrusions for engaging the mullion post in a vertical position.

Figure 3:
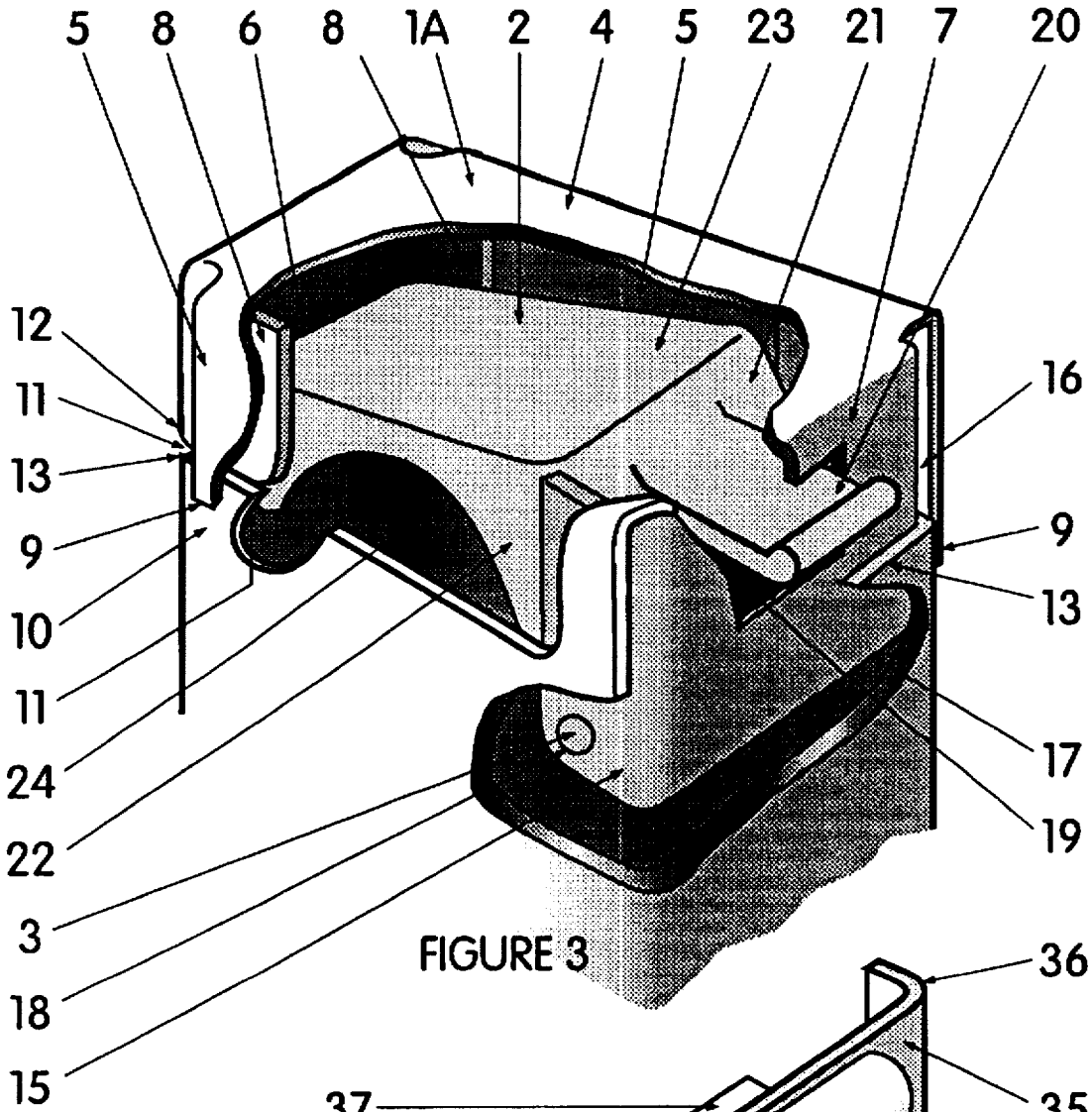

FIG. 3 is an isometric view of the mullion latch of this invention, showing the housing engaged with a fragmentary portion of the upper part of a mullion post, having a cut-out of the top and side of the housing to show the latch bar and a cut-out of the back of the mullion post to show the back of the housing and the latch-key.

Figure 3A:
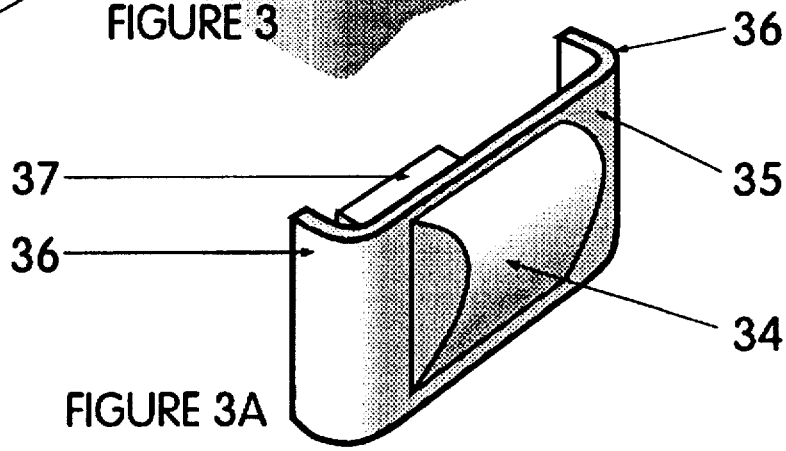

FIG. 3*a* is an isometric view of the cover, which may be made of plastic or other material. The cover is made to plug into the housing of the mullion latch to cover the handle grip from view, protect it from dirt and grime and give the appearance of a continuous mullion post.

Figure 5:
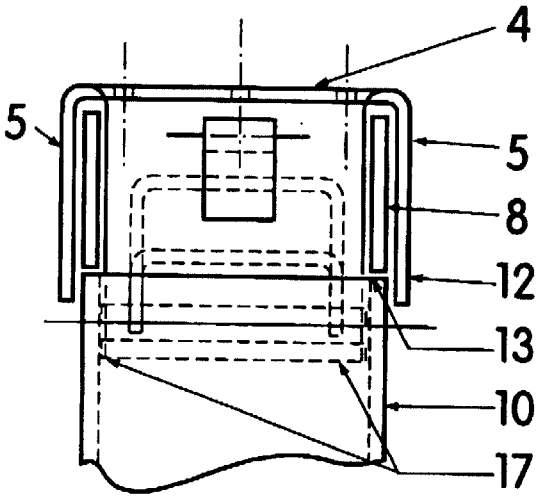
Figure 4:
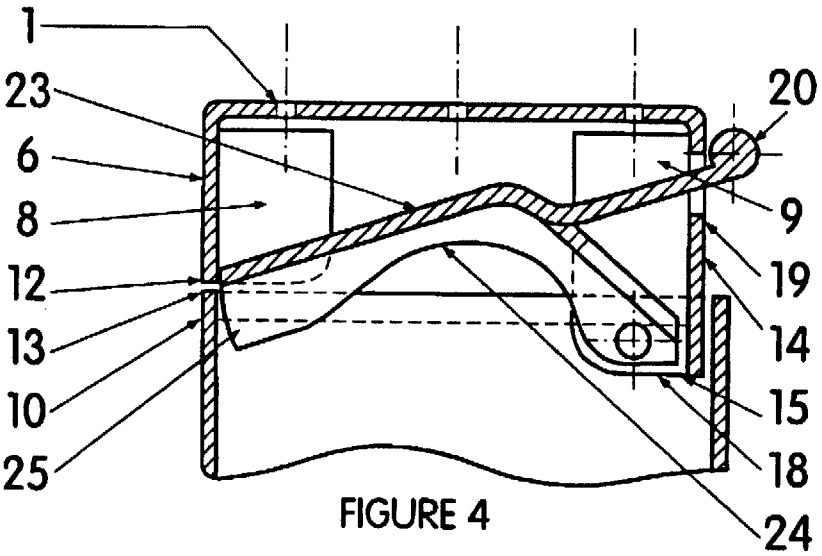
Figure 6:
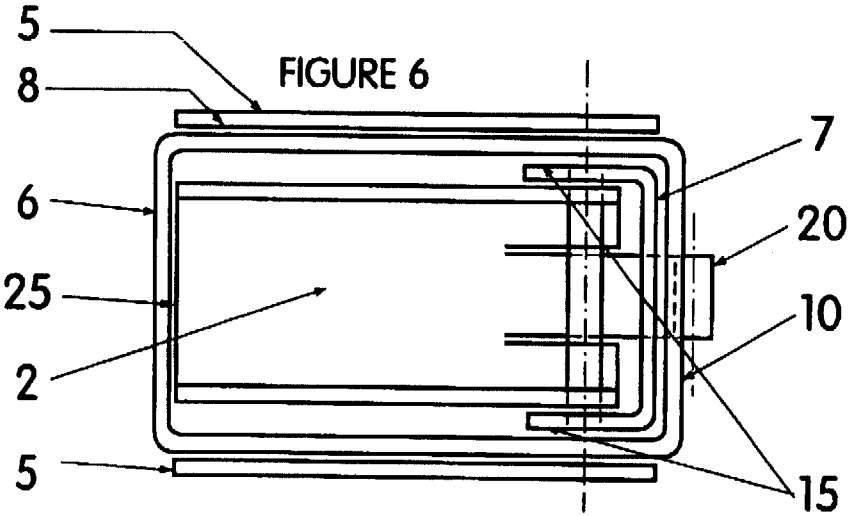

FIGS. 4, 5 and 6 are sectional side, back and bottom views, respectively, in general alignment with each other, showing the detail of the mullion latch including the housing and lever bar mounted on the top of a fragmentary portion of the upper part of a mullion post.

Figure 7:
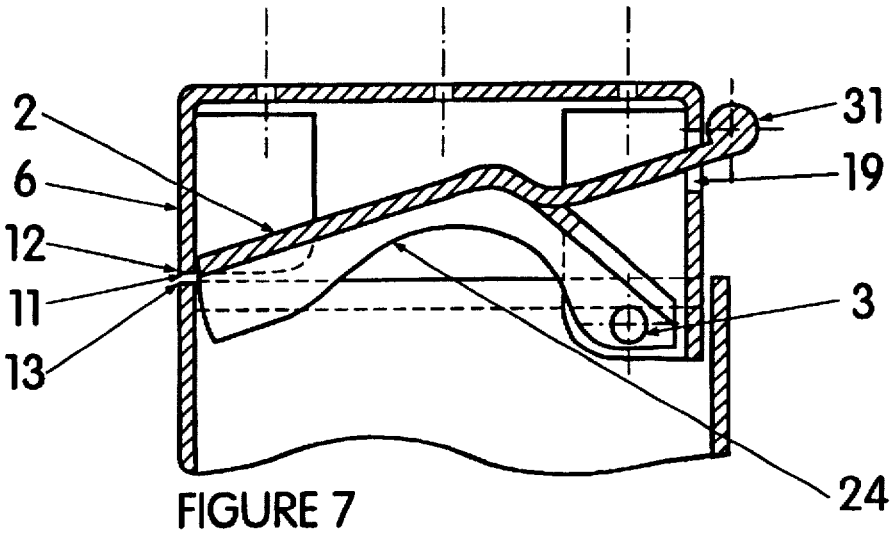
Figure 8:
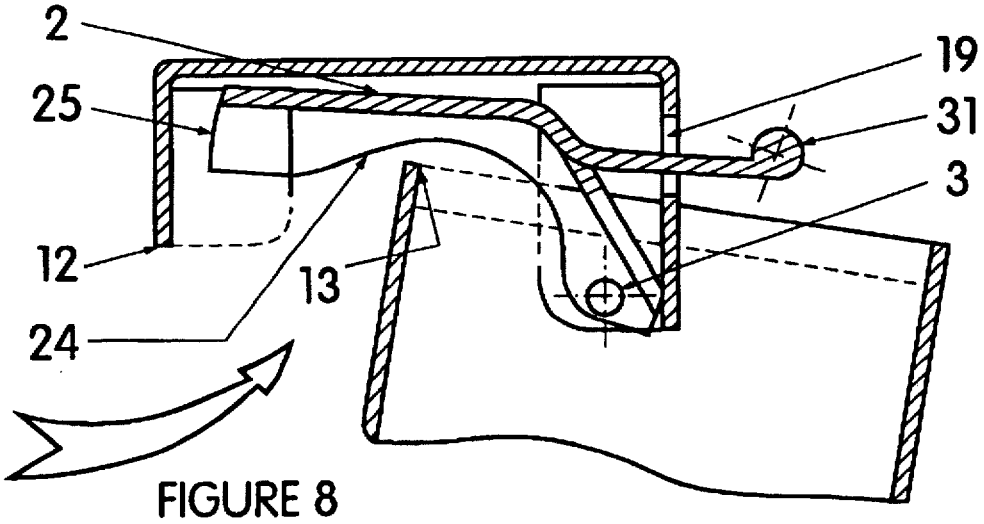
Figure 9:
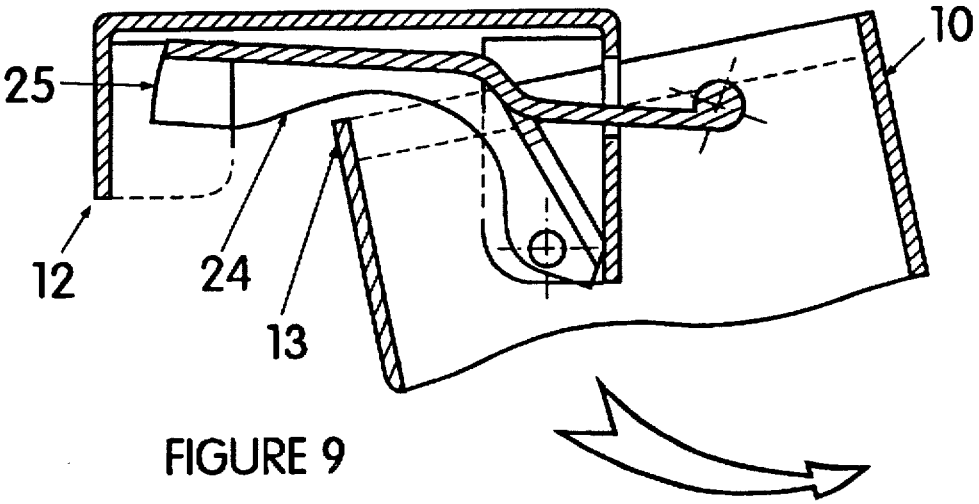

FIGS. 7, 8 and 9 are sectional side views of the mullion latch including the housing and latch bar showing the progressive operating stages of the mullion latch bar in successive operating modes of removing the mullion from its installed position. The installation mode is essentially the reverse of the operation stages shown.

Figure 10:
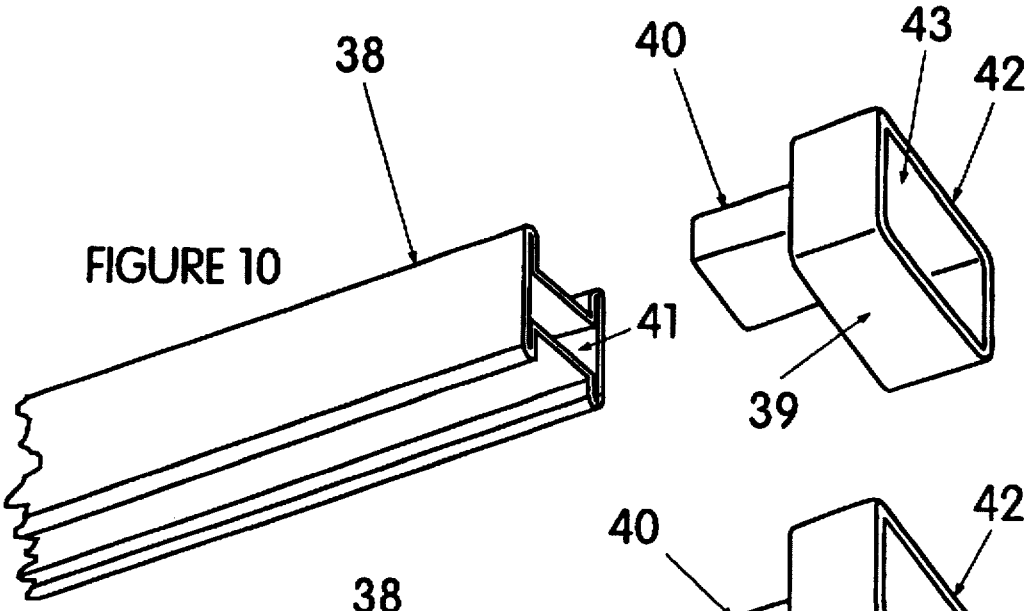
Figure 11:
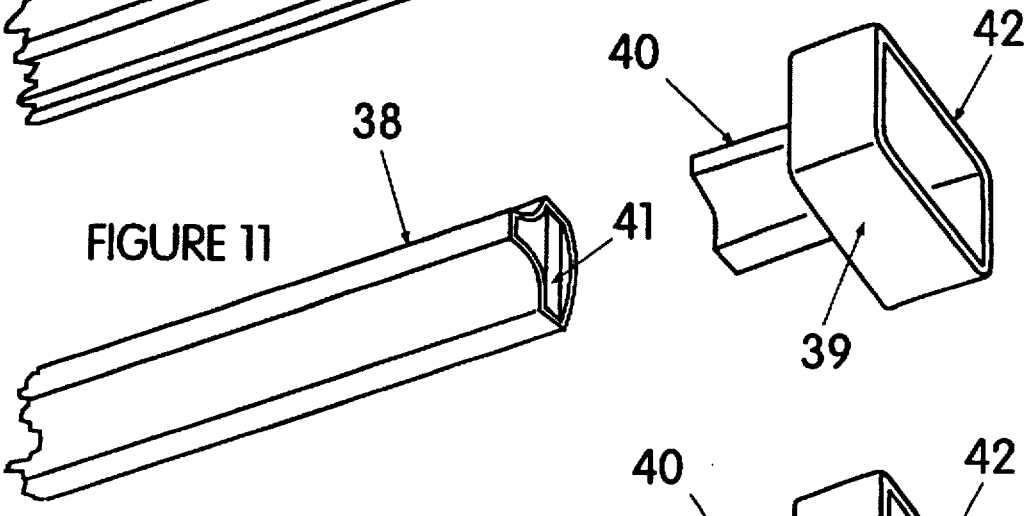
Figure 12:
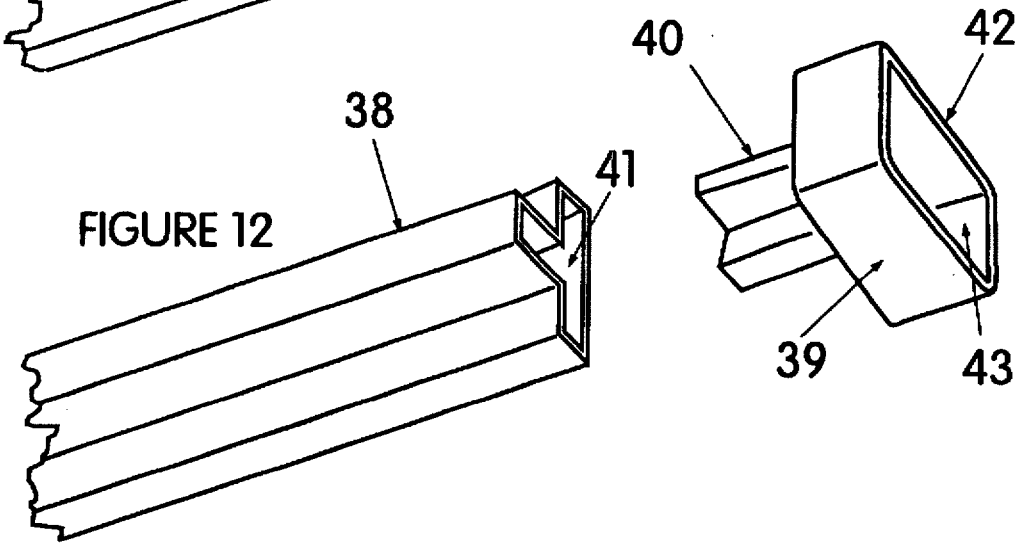

FIGS. 10, 11 and 12 are isometric views of three different mullion posts that are in commercial use also showing adapters of this invention for retrofitting the mullion posts to employ the mullion latch of this invention.

BRIEF DESCRIPTION OF THE INVENTION

The following Brief Description of the Invention is best understood with reference to FIG. 3, which is an isometric view of the mullion latch of this invention, showing the housing engaged with a fragmentary portion of the upper part of a hollow mullion post, having a cut-out of the top and side of the housing to show the latch bar and a cut-out of the back of the mullion post to show the back of the housing and the latch-key.

Figure 1:
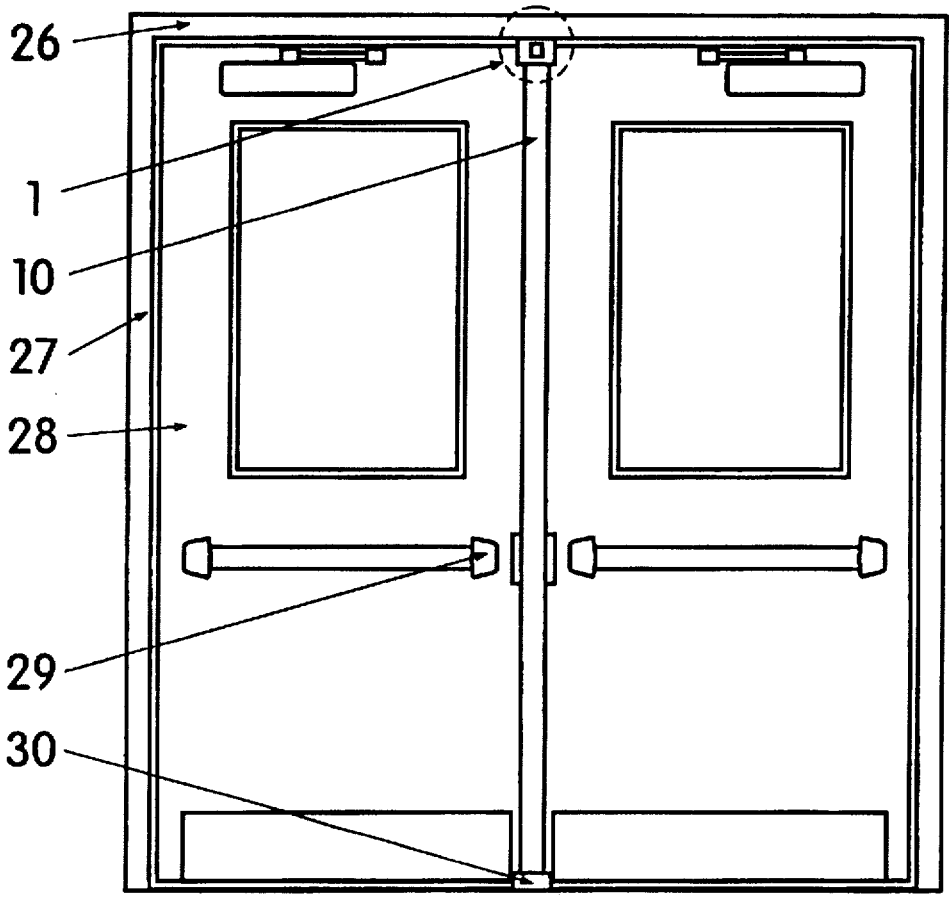
FIG. 1 is an elevation view of a double doorway viewed from the inside having swinging doors in closed position, mounted within a metal frame, with a removable mullion between the doors having locking and opening mechanisms such as panic rim hardware.

The mullion latch, 1, in accordance with this invention is preferably rectangular in shape and comprises a housing, 1*a*, and a lever bar, 2, including a pivot pin, 3. The housing has a top, 4, two sides, 5, that are equivalent in shape, a front, 6, and a back, 7. The top, 4, of the housing, is adapted so that it may be secured in the center of the header of a double door frame, for example by screws, 32, as shown in FIGS. 1 and 2. The front, 6, and back, 7, of the housing face the outside and inside of the doors, respectively. The two sides, 5, of the housing have an extension, 9, that goes on the outside of the mullion post, 10, (shown in the engaged position), and below the joint, 11, made between the bottom-lips, 12, and the top-lip, 13, of the mullion post, 10. In similar manner the front, 6, of the housing extends so that the front bottom-lip, 12, also fits onto the top-lip, 13, of the mullion post, 10, when it is locked. The front, 6, of the housing is shaped to have two front-wings, 8, that fit within the sides, 5, of the housing, 1*a*. The front bottom-lips, 12, of the front-wings, 8, of the housing also fit onto the top side-lips, 13, of the mullion post, 10. An extension, 14, of the back, 7, of the housing extends below the two sides, 5, and is shaped to go inside the back top-lip, 13, of the mullion post, 10, when engaged. The back, 7, of the housing is shaped to have two back-wings, 15, that fit within the mullion post, 10, to form a channel, 16, between the inside surface of the sides, 5, of the housing and the outside surfaces of the back-wings, 15. Said channel, 16, is sized to receive the thickness of the top-lips, 13, of the hollow mullion post, 10, when engaged. The back, 7, of the housing is also shaped so that the back bottom-lips, 17, fit into the back of the mullion post, 10. The extensions of the back-wings, 15, which are below the front bottom-lips, 12, of the front, 6, and sides, 5, are sufficient to allow for holes, 18, to receive a pin, 3, which pivots the lever bar, 2, which will be described later The holes, 18, are below sides, 5, and are positioned to be covered by the top of the mullion post, 10, when it is engaged, but to be accessible when the housing, 1*a*, is separated from the mullion post, 10. The back, 7, has an opening, 19, above the line of the joint, 11, of the housing, 1*a*, and the mullion post, 10, to permit access to a latch-key, 20, on the lever bar, 2, when the housing, 1*a*, containing the lever bar, 2, is engaged with a mullion post, 10.

The lever bar, 2, is shaped to fit snugly within the housing, 1*a*. The lever bar, 2, is secured in the rear of the housing which faces the inside of the doors, by a pivot pin, 3, which is inserted into the two complimentary holes, 18, provided in the back-wings, 15, and the corresponding holes (not shown in FIG. 3) in the sides, 22, of the lever bar, 2. The back, 21, of the lever bar, 2, has a latch-key, 20, which extends through an opening, 19, in the back, 7, of the housing which latch-key has a handle grip, 31. The top, 23, of the lever bar, 2, is flat so that when the latch-key, 20, is depressed, the top, 23, flat surface of the lever bar, 2, meets flush with the top inside surface of the housing, 1*a*. The two sides, 22, of the lever bar, 2, have saddle shaped cut-outs, 24. These saddle shaped cut-outs, 24, are shaped to allow for the removal of the mullion post, 10, to be raised high enough so that the mullion post, 10, will clear the floor base plate, 30, and its retaining protrusions, 33, (not shown in FIG. 3) when being disengaged. The front, 25, of the lever bar, 2, has a top-lip and two side-lips (not shown in FIG. 3) which are contoured so that when in the locked position a cam action is created which tightens and locks the engaged mullion post, 10, in a fixed position.

DETAILED DESCRIPTION OF THE INVENTION

Referring to FIGS. 1 through 12:

FIG. 1 illustrates an elevation view of a double doorway viewed from the inside having swinging doors, 28, mounted within a door frame in closed position, having a door frame header, 26, door frame sides, 27, swing doors, 28, fitted with panic rim hardware, 29, and showing the removable mullion, 10, between the doors fitted onto a base plate, 30, and its retaining protrusions, 33, and locked in place at the top by the mullion latch, 1, thereby locking the mullion post at both the top and bottom of the door frame.

FIG. 2 illustrates an expanded elevation view from inside of the swinging doors, 28, showing the mullion latch housing, 1, secured in the door frame header, 26, by screws, 32, or other attaching means. The opening, 19, for the latch key, and the latch key, 20, are shown exposed to illustrate the ease and accessability for disengaging and removing the mullion post, 10.

FIG. 2*a* illustrates an expanded elevation view from inside of the swinging doors, 28, showing the floor plate, 30, and its retaining protrusions, 33. The floor plate, 30, is secured to the floor by screws or other attaching means (not shown). The retaining protrusions, 33, are of a sufficient height to engage the mullion post, 10, securely in position when it is in the installed vertical position, but not so high as to inhibit the removal of the mullion post, 10. In general the height of the retaining protrusions, 33, should be slightly less than the depth of the saddle cut-outs, 24, in the lever bar, 2. Since the retaining protrusions, 33, will be exposed when the mullion post, 10, is removed to make way for the passage of equipment, furniture, and the like through the open double door frame, it is preferred to maintain the retaining protrusions, 33, in a low profile height.

FIG. 3 is an isometric view of the mullion latch, 1, of this invention, which has been described in detail in the BRIEF DESCRIPTION OF THE INVENTION, it shows the mullion latch housing, 1, engaged with a fragmentary portion of the upper part of a mullion post, 10, having a cut-out of the top, 4, and side, 5, of the housing to show the latch bar, 20, and a cut out of the back of the mullion post, 10, to show the back of the housing, 7, and the latch-key, 20.

FIG. 3a is an isometric view of the cover, 34, which may be made of plastic or other material. The cover, 34, has a back, 35, and sides, 36, and a lug, 37. The lug, 37, plugs into the opening, 19, below the handle grip, 31. The back, 35 of the cover, 34, rests on the back lip, 13, of the mullion post, 10, and the sides, 36, fit into the channel, 16, and cover the back portion of the back wings, 15, thereby covering the back, 7, of the exposed portions of the housing and the back portion of the sides which are exposed to give the appearance of a continuous mullion post. Further, when the cover, 34, is in place with lug, 37, inserted in the opening, 19, a double lock is provided on the latch key, 20. The first locking mechanism is provided by the cam like action of the latch key as described in connection with the description of FIG. 4.

FIGS. 4, 5 and 6 are sectional side, back and bottom views, respectively, in general alignment with each other, showing the detail of the mullion latch housing, 1a, and lever bar, 2, mounted on the top of a fragmentary portion of the upper part of a mullion post, 10.

FIG. 4, the sectional side view of the mullion latch of this invention, illustrates the detail of the latch key, 20, with a handle grip, 31, protruding through the opening, 19, for the latch key, 20. The protruding end of the latch key, 20, is provided with the handle grip, 31, to facilitate hand or finger engagement when releasing the mullion post, 10. It should be noted that the front surface of the lever bar, 25, tightly engages the inside surfaces of both the front of the housing, 6, and the top of the mullion post, 10, thereby providing a secure solid engagement, or locked position, so that there is no movement of the installed mullion post, 10, even when the swinging doors are slammed or by equipment bumping the mullion post when passing through. This locked position is provided for by the position of the pivot pin, 3, so that it provides a cam like action at the front surface, 25, of the lever bar, 20. Furthermore, by positioning the pivot pin, 3, close to the back of the housing, 7, the weight of the lever bar, 2, is concentrated in front of the pivot pin, 3, in the locked position, to provide the locking action without using a spring mechanism. FIG. 4 also shows the top of the mullion post, 10, and the top lip, 13, of the mullion post, 10, and bottom lip of the housings front and sides, 12, forming joint, 11, which is a loose fitting joint, between the bottom lip, 12, of the front of the housing, 1, and the top lip, 13, of the mullion post, 10. By this arrangement the mullion post, 10, is prevented from being raised and is immobilized in the vertical position.

FIG. 5 which is a back view of FIG. 4 which shows the detail of the mullion latch housing, 1a. FIG. 5 also illustrates that the back of the housing, 7, and back wings, 15, also conform in size and shape to the inside of the mullion post, 10, but in a manner that leaves a space between back wings, 15, and housing sides, 5, creating channel, 16, for the top of the mullion post, 10, to slip into.

FIG. 6 which is a bottom view of FIG. 4 shows the detail of the mullion latch housing, 1a, and illustrates the shape of the back wings, 15, and front wings, 8. Also shown is the shape and width of the lever bar, 2, within back wings, 15, and also showing the width of the latch handle, 20. This view also shows the channel, 16, which is between the housing sides, 5 and back wings, 15. FIG. 6 also illustrates that the front of the housing, 6, and front wings, 8, conform to the size and shape of the mullion post, 10.

FIGS. 7, 8 and 9 are sectional side views of the mullion latch including the housing and latch bar showing the progressive operating stages of the mullion latch bar when removing the mullion from its installed position. The installation mode is essentially the reverse of the operation stages shown.

FIG. 7 shows the mullion latch, 1, and mullion post, 10, in the installed position. The lever bar, 2, is in the down position, showing the tight fit and locked position between the front of the lever bar, 25, and the back surface of the extension of the housing, 14, and the inside surface of the mullion post, 10, thereby firmly securing the mullion post, 10, in the vertical position.

FIG. 8 shows the lever bar, 2, in the raised position, showing that the locked position between the front of the lever bar, 25, and the inside surfaces of the front, 6, of the housing and the inside surface of the mullion post, 10, has been unlocked. This is accomplished by simply tripping the handle grip, 31, to its downward position. This unlocking allows the mullion post, 10, to be backed out of the mullion latch, 1, while the bottom of the mullion post, 10, is still partially engaged in the floor plate, 30. (FIG. 1 and FIG. 2a, show the bottom of the mullion post, 10, and the floor plate, 30, in the engaged position.) The unlocking of the top of the mullion post, 10, from the mullion latch, 1, is allowed for by the saddle cut-outs, 24, which permit the top of the mullion post, 10, to be raised into the saddle cut-out spaces, when the mullion post, 10, is lifted to disengage it from the floor plate, 30, and its retaining protrusions, 33.

FIG. 9 shows the lever bar, 2, still in the raised position with the mullion post, 10, being lowered so that the top lip, 13, is moved downward out of the mullion latch, 1, thus permitting easy removal of the mullion post, 10, from the door frame, by one person. (FIG. 1 and FIG. 2a, show the bottom of the mullion post, 10, and the floor plate, 30, in the engaged position, maintained in place by retaining protrusions, 33).

It should be noted that the pivot pin, 3, is positioned below the bottom lip, 12, of the housing front and at the back of the lever bar, 2. This positioning not only permits a cam like action at the front surface, 25, of the lever bar, 2, that locks in the mullion post, 10, but also allows for the mullion post, 10, to be easily installed by one person. From FIGS. 4, 5, and 6, it can be seen that the weight of the lever bar, 2, is concentrated in front of the pivot pin, 3, and because of its free swinging action is readily raised by the top of the mullion post, 10, when the mullion post, 10, is lifted into the installed position. When the mullion post, 10, is in the vertical position, the weight of the free swinging lever bar, 2, positions itself in the locked position. Thus it is not necessary to touch the latch key, 20, or handle grip, 31, during installation of the mullion post, 10, to the vertical position. The channel, 16, which is located between the back wings, 15, and housing sides, 5, allows for the mullion post, 10, when in the engaged position, to cover the pivot pin, 3, and complimentary holes, 18, in the extensions of the back wings, thereby hiding them from exposure in the installed position. The function of channel, 16, is to receive the top lips, 13, of the mullion post, 10, when being installed, so that the top lips, 13, of the mullion post, 10, may engage the bottom lips, 12, of the housing front, 6, and wings, 8, thereby providing a flush fit and support between the mullion post, 10, and the mullion latch, 1, of this invention.

FIGS. 10, 11 and 12 are isometric views of three different mullion posts that are in commercial use and showing adapters of this invention for retrofitting the mullion posts to employ the mullion latch of this invention.

FIG. 10 shows the adapters, 39, in line with one of the more common commercially installed movable mullion posts, 38. In accordance with this invention the adapters, 39, includes an insert, 40, shaped to fit snugly into the hollow core space, 41, of the mullion post, 38. The length of the insert, 40, is sufficient to slip into the hollow core space, 41, of the mullion post, 38, to form a stabilized connection between the surfaces of the parts in contact with each other. It is preferred that all the surfaces of the hollow core space, 41, of mullion post, 38, be in contact with all the outside surfaces of the insert, 40; however, it is only necessary for enough of those surfaces to be in close enough contact to provide a snug and stabilized fit. The adapters, 39, also includes a top portion, 42, which has a hollow core space, 43, that is shaped and sized to conform and fit the rectangular shape of the mullion latch, 1, of this invention, which conforms to the shape of the standard rectangular mullion post, 10, used in describing this invention. The top portion, 42, of the adapters, 39, is of a length so that it may be engaged into the mullion latch, 1, of this invention, and it may be made from a cut-off piece of a standard mullion post because it will be engaged in the mullion latch, 1, in the same manner as that described in connection with FIGS. 7, 8, and 9 for installing or removing the mullion post, 10. In order to use the adapters, 39, of this invention with an existing mullion post, 38, to retrofit the installation in accordance with this invention, a piece of the top of the mullion post, 38, is cut off so that the million post, 38, will match the length between the floor plate, 30, and the front lip, 12, of the mullion latch 1. Accordingly, by cutting off a piece of the top of the mullion post, rather than from the bottom, the fittings for the panic rim locking mechanism are in the same height and position from the floor in the retrofitted mullion post as they were in the original mullion post, thereby obviating any changes in the location of such hardware, and further, the existing floor plate and retaining protrusions may be used as is. The retrofitted mullion post employing the adapters of this invention is installed and removed in the same manner described herein, as for example in connection with FIGS. 7, 8, and 9, and may be readily inserted and removed from the door frame, as many times as desired, realizing the advantages and objectives of this invention. The mullion latch, 1, of this invention is capable of being employed with various shaped movable mullion posts, 38, already installed and in use in existing structures through out the world, as is further exemplified in the following Figures.

FIGS. 11 and 12 show the shapes of other movable mullion posts, 38, in commercial use that may be retrofit, by the retrofit assembly kit provided in accordance with this invention. All that is required to retrofit an existing movable mullion post, to employ the mullion latch of this invention, is to employ an adapters, 39, having an insert, such as, 40, which conforms in shape and contour to the cross section of the hollow core in the movable mullion post, 38, and which also has a top portion, 41, conforming in shape to the mullion latch of this invention. Thus, in accordance with the foregoing disclosure, the retrofit assembly kit of this invention comprises a mullion latch and an adapters; a cover for the latch key opening and a hollow core mullion post also may be included.

It should be understood that FIGS. 10, 11 and 12 show an adapters, 39, which has a top portion, 42, which is the preferred rectangular shape, which happens to be one of the more prevalent shapes for removable mullion posts currently in commercial use. Further, it should be understood that this invention is also applicable to converting permanently installed mullion posts to become removable mullion posts. For example, in those installations where the mullion post is welded to the double door frame header, all that is required to convert it to a removable mullion post in accordance with this invention is to cut out the permanently installed mullion post at the header and extract the bottom of the mullion post from the floor. The mullion latch of this invention is installed in the header, and the floor plate with its retaining protrusions are installed beneath it on the floor, thereby allowing for a removable mullion post to be engaged in accordance with this invention. Double door frame assemblies that are hollow core and made of metals such as iron, steel, aluminium, or reinforced plastics and the like may be suitably used with this invention. Obviously, and with out departing from the intent and scope of my invention, the mullion latch of this invention may be made to conform in shape and cross section with any of the cross sections of the other shapes of mullion posts in use, such as those shown in FIGS. 10, 11, and 12, and which are given as examples, and still other cross section shapes of mullion posts, not shown. In such cases all that is necessary is to employ a shape or cross section of an adapters insert, 40, to conform and compliment each other so they fit together.

Although I have exemplified my invention using preferred embodiments thereof, it is understood that departures may be made therefrom within the scope of my invention, which is not limited to the details disclosed herein, but is to be accorded the full scope of the appended claims so as to embrace any and all equivalents.

I claim:

1. A mullion latch for connecting removable mullion posts to headers in double door frames, comprising:

a housing having a rectangular cross section, with means for securing the housing to a header, said housing having front and front wing bottom lips that fit onto corresponding top lips of the removable mullion post, and back extension and back wing bottom lips that fit below and inside corresponding top lips of the removable mullion post, said housing also having side extensions that fit below and outside corresponding top lips of the removable mullion post, thereby forming a channel adapted to receive the top sides of the removable mullion post, to create a close fit of the top of the removable post within the mullion latch, and a lever bar shaped to fit within the inside of the housing, which lever bar is secured in the back wing and below the front bottom lips of the housing, by a pivot pin passing through corresponding holes in both sides of the housing and the lever bar, and having a weight concentration in front of the pivot pin, the lever bar having a latch key which protrudes through an opening in the back of the housing, said lever bar having saddle shaped cut-outs on each of its sides, shaped to provide clearance for removal or installation of the removable mullion post, the front and sides of said lever bar being longer than the distance between the pivot pin and the front bottom lips, thereby creating a locking action between the outside surface of the back of the housing and the inside surface of the top of the removable mullion post, which action tightens and locks the removable mullion post.

2. A mullion latch for removable mullion posts for use in double door frames in accordance with claim 1, wherein the cross section of the mullion latch is rectangular in shape and corresponds to the rectangular shape of the mullion post it is to be engaged with.

3. A mullion latch for removable mullion posts for use in double door frames in accordance with claim 1, wherein the thickness of the channel corresponds to the thickness of the top lips of the hollow mullion post thereby producing a stabilized fit.

4. A mullion latch for removable mullion posts for use in double door frames in accordance with claim 1, wherein the side extensions maintain the mullion post in stabilized vertical alignment.

5. A mullion latch for removable mullion posts for use in double door frames in accordance with claim 1, wherein the weight concentration in the lever bar is concentrated in front of the pivot pin, and the lever bar is free swinging to permit a secured locked position when in the engaged position with a removable mullion post.

6. A mullion latch for removable mullion posts for use in double door frames in accordance with claim 1, wherein the latch key protruding through the opening in the back of the housing has a handle grip and wherein a cover is plugged into said opening.

7. A mullion latch in accordance with claim 1 when installed in a double door frame engaging a vertical removable mullion post that is secured in a floor plate having retaining protrusions.

8. A mullion latch for removable mullion posts for use in double door frames in accordance with claim 7, wherein the saddle cut outs in the sides of the lever bar are deeper than the height of the retaining protrusions in the floor plate.

9. An adapters for retrofitting an installed mullion post to make it readily removable or installable by one person which comprises a rectangular top corresponding in shape and size to the mullion latch of claim 1, said adaptor having an insert corresponding in shape to the hollow core space of the mullion post being retrofitted.

10. An adapters for retrofitting an installed mullion post in accordance with claim 9 wherein the cross section of the insert corresponds in shape to the hollow core space of the mullion post.

11. An adapters for retrofitting an installed mullion post in accordance with claim 10 wherein the length of the insert is sufficient to form a stabilized connection between the outside surfaces of the insert and the inside surfaces of the hollow core space of the mullion post.

12. An adapters for retrofitting an installed mullion post in accordance with claim 9 wherein the length of the top portion of the adapters is sufficient to be installed in the mullion latch.

13. An assembly kit for retrofitting an installed mullion post to make it readily removable or installable by one person which comprises a mullion latch and an adapters of claim 9.

14. An assembly kit for retrofitting an installed mullion post to make it readily removable or installable by one person in accordance with claim 13 which includes a cover that plugs into the opening below a handle grip in the back of the housing.

15. An assembly kit for retrofitting an installed mullion post to make it readily removable or installable by one person in accordance with claim 14 which includes a hollow core mullion post.

16. A mullion latch in combination with a removable mullion post for use in double door frames, comprising:

a rectangular housing corresponding to the cross section of the removable mullion post, means for securing the housing to a door frame header, said housing having front and front wing bottom lips that fit onto corresponding top lips of the removable mullion post, and back extension and back wing bottom lips that fit below and inside corresponding top lips of the removable mullion post, said housing also having side extensions that fit below and outside corresponding top lips of the removable mullion post, thereby forming a channel adapted to receive the top sides of the removable mullion post, to create a close fit of the top of the removable post within the mullion latch, and a lever bar shaped to fit within the inside of the housing, which lever bar is secured in the back wing and below the front bottom lips of the housing, by a pivot pin passing through corresponding holes in both sides of the housing and the lever bar, and having a weight concentration in front of the pivot pin, the lever bar having a latch key which protrudes through an opening in the back of the housing, said lever bar having saddle shaped cut-outs on each of its sides, shaped to provide clearance for removal or installation of the removable mullion post, the front and sides of said lever bar being longer than the distance between the pivot pin and the front bottom lips, thereby creating a locking action between the outside surface of the back of the housing and the inside surface of the top of the removable mullion post, which action tightens and locks the removable mullion post.

17. A mullion assembly comprising the mullion latch and removable mullion post of claim 16 when in combination with a double door frame wherein the top of the removable mullion post is secured to the header by the housing of the mullion latch and the bottom of the mullion post is secured by a floor plate having retaining protrusions of sufficient height thereby allowing for secure fit and easy removal of the mullion post, said height being less than the height of the saddle cut outs in the lever bar.

* * * * *